United States Patent [19]

Focke et al.

[11] Patent Number: 4,843,798

[45] Date of Patent: Jul. 4, 1989

[54] PROCESS AND APPARATUS FOR PRODUCING PACKS WITH BEVELLED OR ROUNDED LONGITUDINAL EDGES

[75] Inventors: Heinz Focke, Verden; Hugo Mutschall, Kirchlinteln, both of Fed. Rep. of Germany

[73] Assignee: Focke & Co. (GmbH & Co.), Verden, Fed. Rep. of Germany

[21] Appl. No.: 147,841

[22] Filed: Jan. 25, 1988

Related U.S. Application Data

[62] Division of Ser. No. 873,018, Jun. 11, 1986, Pat. No. 4,730,442.

[30] Foreign Application Priority Data

Jun. 25, 1985 [DE] Fed. Rep. of Germany ..... 3522614

[51] Int. Cl.[4] ..... B65B 19/20; B65B 97/04

[52] U.S. Cl. ..... 53/453; 53/456; 53/462; 493/169; 493/911

[58] Field of Search ..... 53/453, 456, 575, 578, 53/579, 207, 221, 222, 223, 225, 230, 231, 462; 493/162, 167, 911; 206/208, 273; 229/109, 160.1

[56] References Cited

U.S. PATENT DOCUMENTS

| | | | |
|---|---|---|---|
| 1,892,715 | 1/1933 | Wellman | 229/109 |
| 2,062,540 | 12/1936 | Vogt | 53/462 |
| 3,956,865 | 5/1976 | Schmermund | 53/234 X |
| 4,020,988 | 5/1977 | Kipp | 229/106 X |
| 4,084,393 | 4/1978 | Focke | 53/207 X |
| 4,341,055 | 7/1982 | Williams | 53/462 |
| 4,708,704 | 11/1987 | Focke | 493/911 |
| 4,753,384 | 6/1988 | Focke | 229/160.1 |

*Primary Examiner*—John Sipos

*Attorney, Agent, or Firm*—Sughrue, Mion, Zinn, Macpeak & Seas

[57] ABSTRACT

In the apparatus used for producing cuboid (cigarette) packs of the hinge-lid type having bevelled or rounded longitudinal edges (37,38,39,40) the blank is brought into an angular intermediate folding position thereby erecting the side tabs and forming the bevelled or rounded longitudinal edges. For this purpose, the blank is pressed, by means of a shaping punch (58) with punch plate (59), into a pocket (47) of a folding turret (46), the blank parts being folded, thereby forming the bevelled longitudinal edges, by means of stationary or movable folding tools.

3 Claims, 9 Drawing Sheets

PROCESS AND APPARATUS FOR PRODUCING PACKS WITH BEVELLED OR ROUNDED LONGITUDINAL EDGES

This is a Division of application Ser. No. 873,018 filed June 11, 1986. Now U.S. Pat. No. 4,730,442.

BACKGROUND OF THE INVENTION

The invention relates to a process for producing essentially cuboid packs, especially cigarette packs of the hinge-lid type, from a blank having regions at least for the front wall, rear wall, side tabs for side walls and bottom wall. The invention also relates to an apparatus for carrying out the process.

A considerable number of the cigarette packs on the international market are designed as hinge-lid packs. In the standard design, a pack part consists of front wall, rear wall, side walls and bottom wall. A hinge lid consisting of lid rear wall, lid top wall, lid front wall and lid side walls is hinged to the rear wall. The lid side walls are formed from lid side tabs arranged on the lid rear wall and lid front wall.

SUMMARY OF THE INVENTION

The invention is concerned with a development in the design of this type of pack and of other packs. Its particular feature is that selected edges which are right-angled on known packs, in particular longitudinal edges, are bevelled (polygonal) or rounded. The dimensions of the bevel or rounding are appropriately matched with the diameter of the cigarettes.

The object on which the invention is based is, therefore, to provide a process and an apparatus for producing packs with bevelled or rounded (longitudinal) edges.

To achieve this object, the process according to the invention consists in that, to form a pack with bevelled or rounded (longitudinal) edges, the front wall together with the bottom wall, as well as the side tabs arranged on the rear wall are simultaneously folded into an upright position relative to the rear wall, thereby forming the rear bevelled or rounded longitudinal edges, that the side tabs arranged on the front wall are thereafter folded into a position which is transverse relative to the front wall, likewise thereby forming the bevelled or rounded front longitudinal edges and that finally folding of the pack is completed after the latter has been filled.

The rear longitudinal edges, i.e. the longitudinal edges facing the rear wall, on the one hand and the front longitudinal edges on the other hand are thus folded, according to the invention, into their positions in consecutive folding steps, at the same time forming the bevel or rounding. During the first folding step the blank is brought into an angular intermediate folding position in a pocket of a folding turret, at the same time erecting the side tabs in the region of the rear wall and lid rear wall and forming the rear bevelled or rounded longitudinal edges as a result of appropriately designed folding and shaping tools. The blank regions forming the lid form an extension of a horizontal blank leg. According to the invention, the lid side tabs in the region of the lid front wall are likewise folded into their upright position during a separate working step, in particular at the same time as the side tabs of the front wall, thereby forming bevelled or rounded (longitudinal) edges.

Further folding steps are then carried out in the same station, in particular an inner tab arranged on the radially outer end of the horizontal blank leg is folded into its position on the inside of the lid front wall. The lid side tabs which are initially formed into an upright position, thereby forming the bevelled or rounded edges, are then brought back into an approximately horizontal initial position before the blank, which has been prefolded to this extent, is brought into a different folding position (advancing the folding turret).

The apparatus according to the invention is derived from that of German Offenlegungsschrift No. 2,440,006, corresponding to U.S. Pat. No. 4,084,393. The stations for filling and completing the pack in particular can be designed in the manner described in the abovementioned Offenlegungsschrift.

According to this, a plate-shaped folding turret which is rotatable about a vertical axis, and has pockets open at the top and at the radially outer side for receiving one blank each time, is provided. The blanks are supplied in a flat state along a blank-conveying track above a first folding station and, by means of a downward movement of a shaping punch, are inserted into the pocket of the folding turret. The pocket on the one hand and the shaping punch and/or punch plate on the other hand are designed, i.e. profiled, in such a way that by pressing the blank or the horizontal blank leg against the bottom of the pocket the side tabs are erected and at the same time the bevelled or rounded longitudinal edges in this region are formed.

The appropriate shaping of the side tabs arranged on the front wall takes place in the region of the same folding station by a folding member which can be moved horizontally to and fro, interacts with an upright leg of the punch plate and likewise forms the bevelled or rounded longitudinal edges while the side tabs are simultaneously being erected.

Further special features of the apparatus relate to folding tools for shaping the lid side tabs arranged on the lid front wall and for the inner tab likewise arranged on the hinge lid, in each case in the region of the same, first folding station of the folding turret.

The apparatus is particularly suitable for producing hinge-lid packs having bevelled longitudinal edges, but is also suitable for other pack types, e.g. cup-shaped packs, likewise having bevelled or rounded longitudinal edges.

BRIEF DESCRIPTION OF THE DRAWINGS

An exemplary embodiment of a hinge-lid pack having bevelled longitudinal edges and an exemplary embodiment of an apparatus for producing packs of this type are explained below with reference to the drawings.

DETAILED DESCRIPTION OF THE PREFERRED EMBODIMENT

Figure 1:
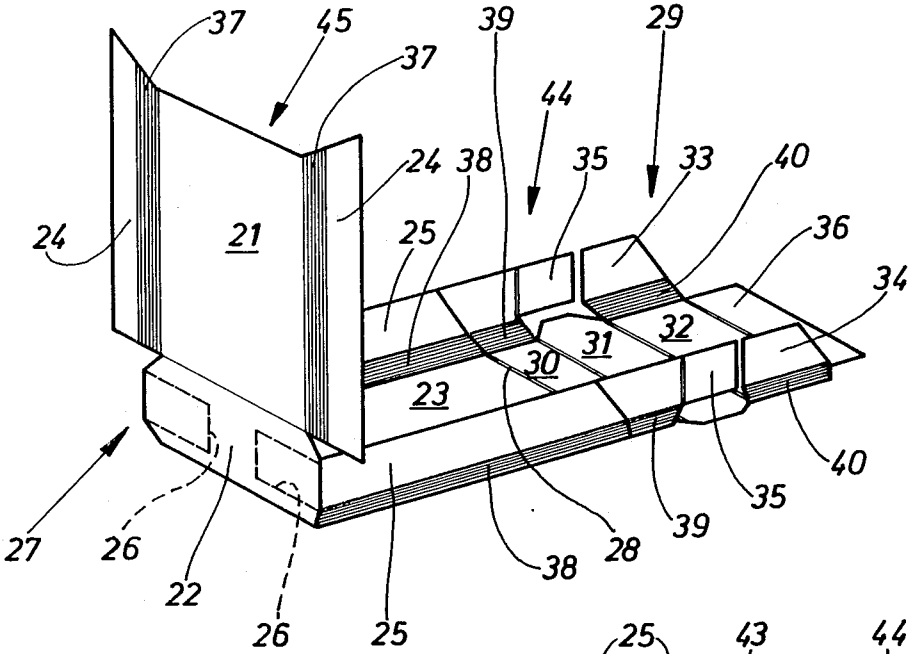
FIG. 1 shows a blank for a hinge-lid pack with bevelled longitudinal edges in an angular intermediate folding position.
Figure 2:
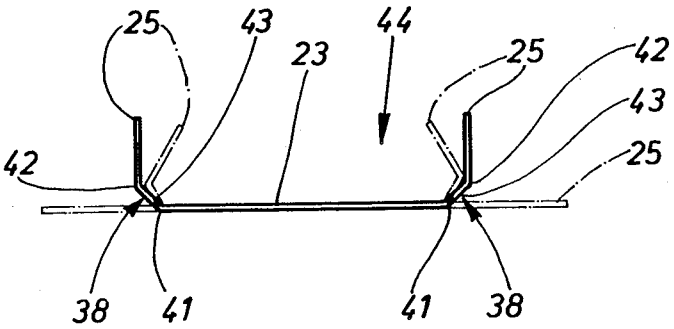
FIG. 2 shows a section 11—11 in FIG. 1.

The blank 20 shown in an intermediate folding position in FIGS. 1 and 2 is intended for a (cigarette) pack of the hinge-lid type. For this purpose, regions are defined within the blank for forming front wall 21, bottom wall 22 and rear wall 23. Side tabs 24 are arranged on the front wall 21 and further side tabs 25 are arranged on the rear wall 23, which, while partially overlapping, form narrow side walls of the essentially cuboid pack. Bottom corner tabs 26 are arranged on the lower ends of the side tabs 25 and, in the finished pack, are folded against the inside of the bottom wall 22. The blank parts described to this extent form a part 27 of the pack.

The rear wall 23 is adjoined by a hinge lid 29 via a hinge 28. This hinge-lid consists of the lid rear wall 30, lid top wall 31 and lid front wall 32 blank parts. The lid rear wall 30 and lid front wall 32 are each adjoined on the sides by lid side tabs 33 and 34 for forming the lid side walls as a continuation or extension of the side walls of the pack part 27. Furthermore, in each case a lid corner tab 3 which is folded against the inside of the lid top wall 31 is attached as a continuation of the lid side tabs 33. An inner tab 36 arranged at the end of the blank, in particular at the free side of the lid front wall 32 is folded against the inside of the lid front wall 32 and is used to reinforce the latter.

In the present pack the (upright) longitudinal edges 37 and 38 thereof are designed in a special way. The longitudinal edges 37 and 38 of the pack part 27 as well as the lid longitudinal edges 39 and 40 are designed as a bevel or bevelled edge. The pack is thereby given an altogether octagonal cross-section. Each of the longitudinal edges 37 to 40 consists of two individual edges 41 and 42, between which a blank strip 43 of limited width extends diagonally. The angles included in the region of the individual edges 41, 42 are equally large. The width of the blank strip 43 is matched with the diameter of a cigarette so that the latter can adapt in a space-saving manner, to the contour of the blank in the region of the longitudinal edges 37 to 40.

The bottom wall 22 and lid top wall 31 are matched to the above-described pack design, specifically each has a octagonal plan.

When producing a hinge-lid pack from a blank of the design described, the procedure adopted is one in which, in a first working or folding cycle, the blank is brought into an angular position (FIG. 1). A horizontally oriented blank leg 44 is essentially formed by the rear wall 23 with the adjoining side tabs 25 and by the blank parts for the hinge lid 29. An upright blank leg 45 consists of the bottom wall 22, front wall 21, and the adjoining side tabs 24. In this first common folding cycle the bottom corner tabs 26 are brought into their position (up against the inside of the bottom wall 22). Moreover, the side tabs 25 and the lid side tabs 33 are erected, thereby specifically forming the bevelled longitudinal edges 38 and 39 in this blank region.

In the subsequent folding cycle the side tabs 24 are folded, thereby forming the bevelled longitudinal edges 37, into a position transverse relative to the (erected) front wall 21. Furthermore the lid side tabs 34 connected with the lid front wall 32 are erected simultaneously forming the lid longitudinal edges 40.

The next folding step consists in folding the inner tab 36, which has already been brought into an oblique position, against the inside of the lid front wall 32. At the same time the previously erected lid side tabs 34 are moved back into an approximately horizontal initial position. The blank prefolded to this extent is thus open at the top and on the radially outer side (region of the hinge lid 29) so that the pack content (cigarette block) can be inserted into the blank in the radial direction.

The apparatus for carrying out the foldings described corresponds in its design largely to that according to German Offenlegungsschrift No. 2,440,006. This applies in particular to the stations for filling and completing the pack.

The essential element of the apparatus is a folding turret 46 having a plurality of pockets 47 arranged along the periphery and each intended for receiving a blank 20. The folding turret 46 is designed as a flat plate and is rotatable about an upright axis (clockwise).

In the region of a first folding station A the flat blanks 20 are fed to the folding turret 46. For this purpose, there extends above the folding turret 46 in the region of the folding station A a blank-conveying track 48 pointed obliquely downwards in the conveying direction. Between a top guide 49 and a bottom guide 50 the blank 20 is supplied by conveying rollers 51 up to an end position in an exact relative position above a pocket 47 in the region of the folding station A. In the end position the blank 20 with the front end (inner tab 36) comes to rest against a stop piece 52. The blank 20 is laterally aligned in this position by means of a side alignment member 54 which can be moved to and fro in the transverse direction and is moved up laterally against the blank 20 so that the latter becomes aligned in the blank-conveying track 48 on the opposite side (see FIG. 7).

Figure 6:
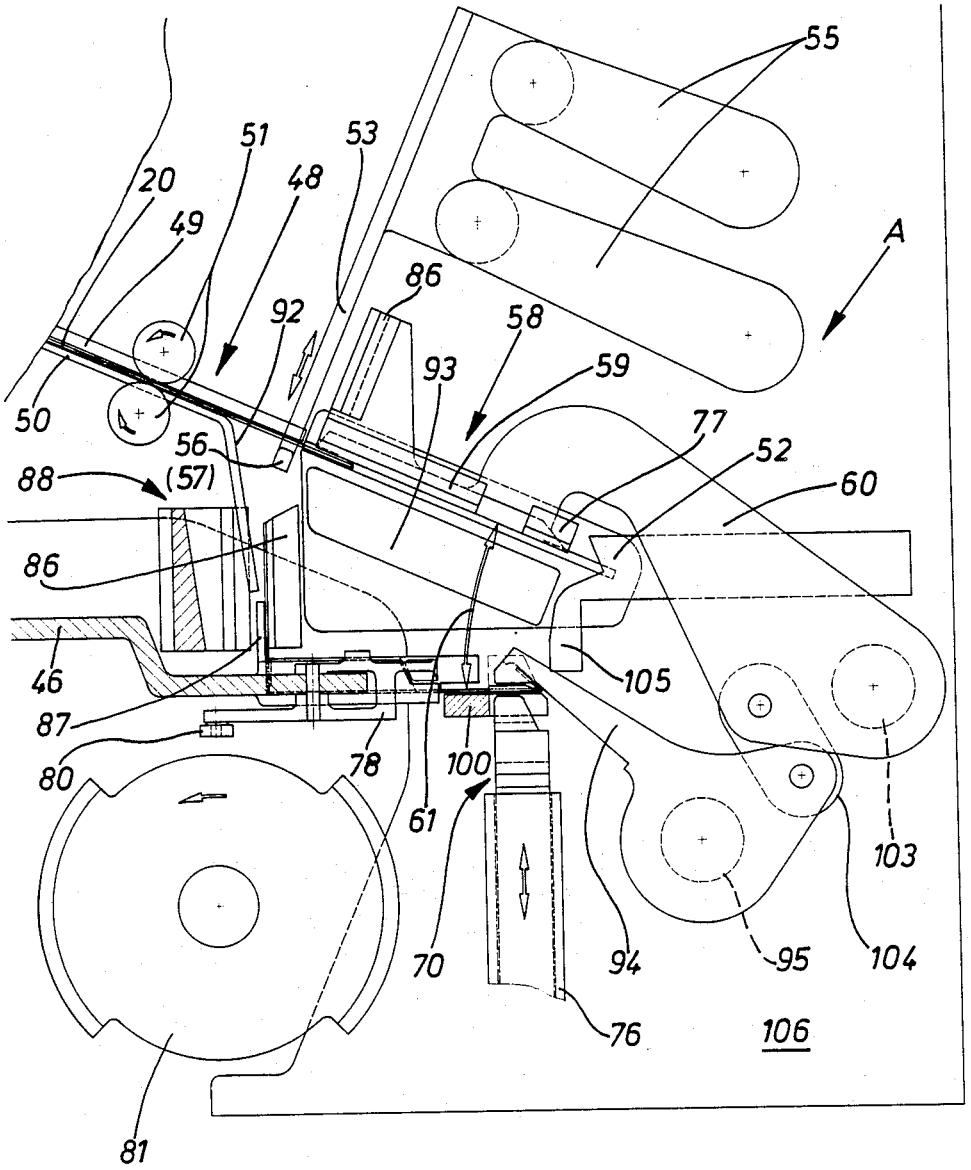
FIG. 6 shows a further radial section in the region of the first folding station with the relative position of the folding tools changed.

After positioning the blank 20 or at the same time as this positioning, the bottom corner tabs 26 are preformed or prefolded by angling or erecting the latter. For this purpose there is located in the region of the blank-conveying track 48 a corner tab folder 53 so as to be displaceable in parallel, in particular on the parallel lever 55. The C-shaped corner tab folder 53 is equipped with folding fingers 56, 57 which project from the sides into the region of the two bottom corner tabs 26. Upward movement or transverse movement relative to the blank 20 (FIG. 6) results in the bottom corner tabs 26 being erected, and thus prefolded, by the folding fingers 56, 57.

The blank 20 is now inserted into the pocket 47 of the folding turret 46 by means of a downward movement, in particular by means of a shaping punch 58 having a punch plate 59, which can be moved up and down. In the present case, the shaping punch 58 is attached to an angled or arc-shaped pressure lever 60 which is pivotably mounted and effects movement of the shaping punch 58 along the orbit 61.

The punch plate 59 of the shaping punch 58 is dimensioned so that rear wall 23, lid rear wall 30, lid top wall 31 and lid front wall 32 are covered. The dimensions of the pocket 47 are such that rear wall 23 as well as lid rear wall 30 are pressed against a pocket bottom 62 by means of the punch plates 59.

The designs of the punch plate 59 and pocket bottom 62 are matched with one another. As can be seen, for example, from FIG. 7 the punch plate 59 is designed with a polygonal cross-section, in particular with outer corners 63 and 64 for forming the individual edges 41 and 42 in the region of the rear longitudinal edges 38 and 39 when pressing the corresponding blank parts into the pocket 47. Accordingly, the pocket 47, which is of dish-shaped cross-section, is provided, in the region of the transition between the pocket bottom 62 and the pocket side walls 65, with inner corners 66, 67 opposite the outer corners 63 and 64. Thus, the punch plate 59 and pocket 47 bear the same relation to one another as the male mold to the female mold..

Figure 7:
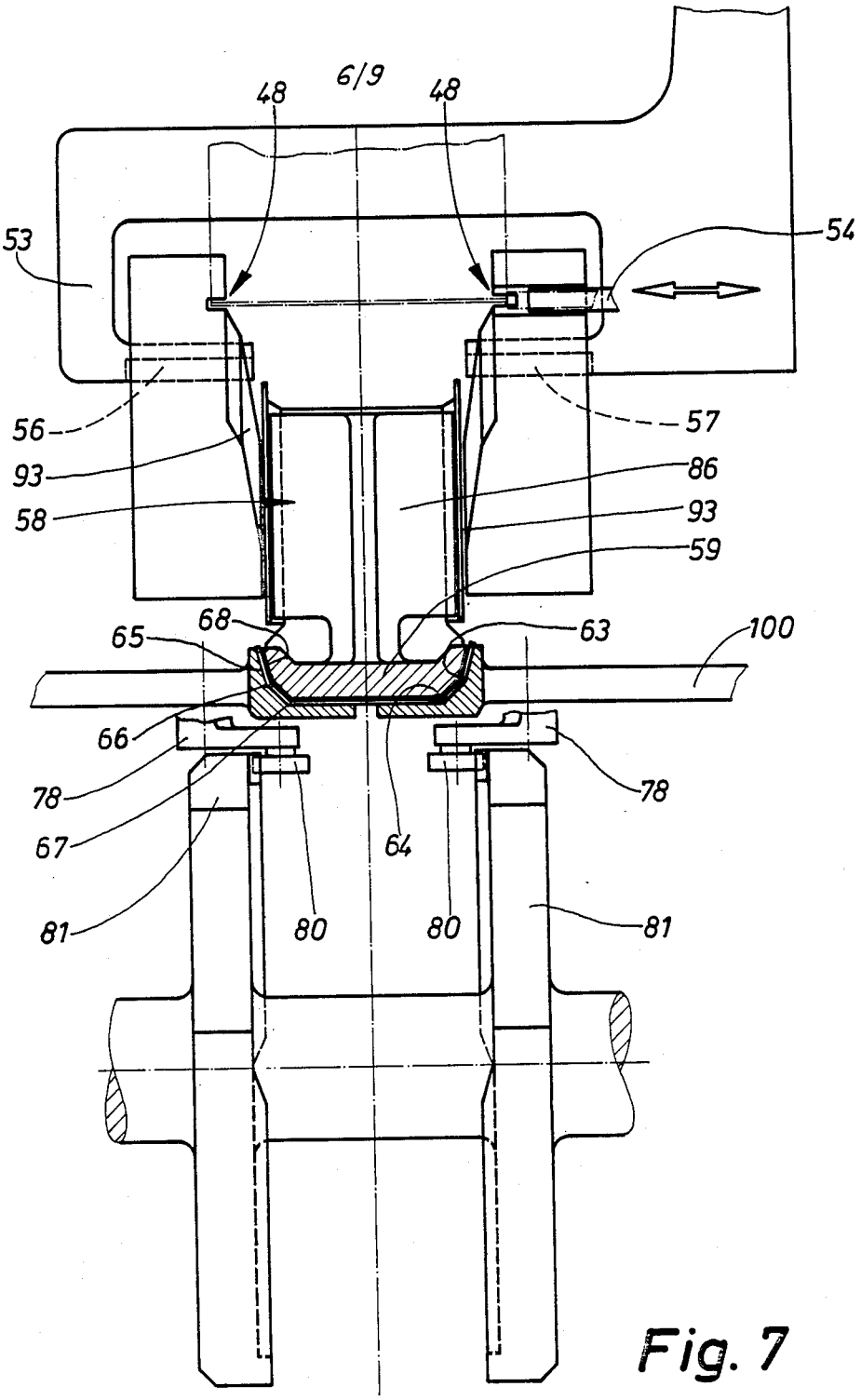
FIG. 7 shows a cross-section through a pocket in the folding turret in the sectional plane VII—VII of FIG. 4.
Figure 8:
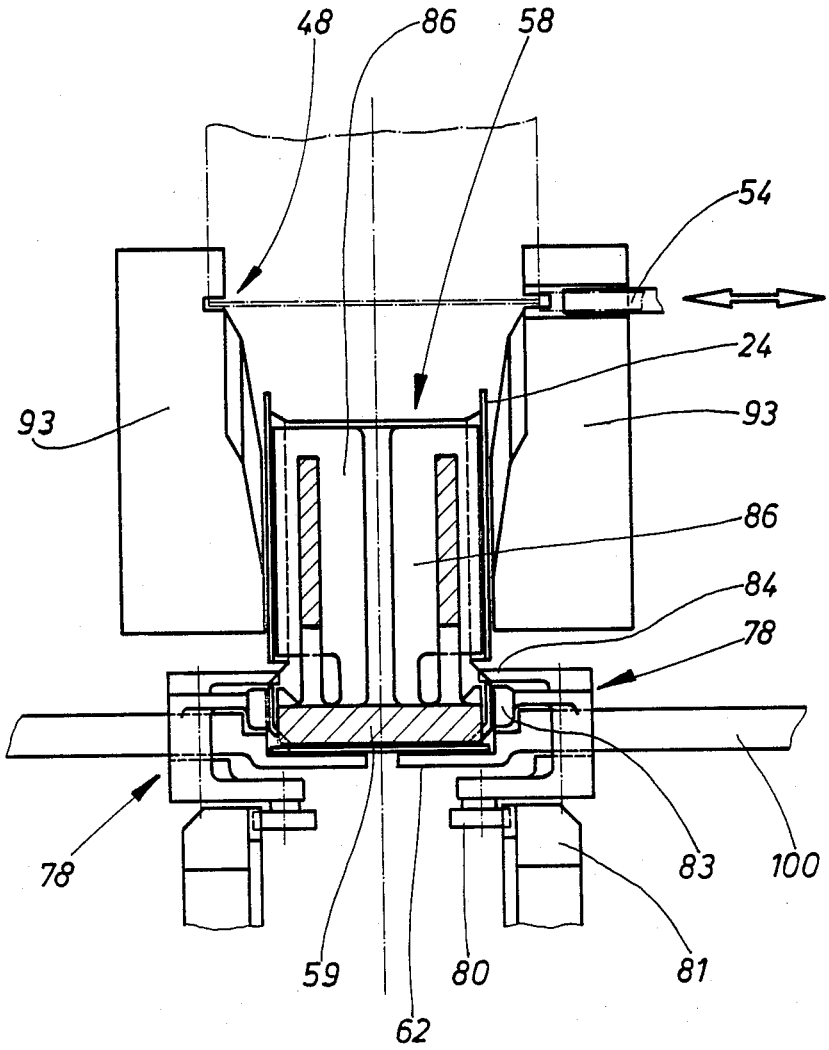
FIG. 8 shows a corresponding cross-section in the sectional plane VIII—VIII of FIG. 4.

In the present exemplary embodiment the shaping surfaces, facing each other, of the pocket side walls 65 on the one hand and of the punch side surfaces 68 on the other hand are arranged obliquely, in particular diverging upwards. The blank 20 and the side tabs 25 and lid side tabs 33, respectively, are thereby brought into an intermediate folding position diverging upwards (FIG. 7).

Pocket 47 and punch plate 59 are designed with a cross-section which changes across their length. In the region of the lid rear wall 30 the cross-section of pocket 47 and punch plate 59 corresponds roughly to the representation according to FIG. 9, that is to say with an upright inner side of the pocket side wall 65 and correspondingly upright outer surfaces of the punch plate 59. As a result, the lid side tabs 33 are folded into a vertical position in the region of the lid rear wall 30, that is to say with a small angular offset relative to the side tabs 25 in the region of the rear wall 23. This results in a bevelled edge 69 formed between the side tabs 25 on the one hand and 33 on the other hand being exposed so that a holding member for fixing the blank in the pocket 47 can come to rest against this bevelled edge 69.

The pocket 47 terminates approximately in the region of the transition between the lid rear wall 30 and the lid top wall 31. The latter is exposed outside the pocket 47. There is also no limitation for the lid corner tabs 35 on the sides, since the latter are automatically erected together with the lid side tabs 33.

Figure 9:
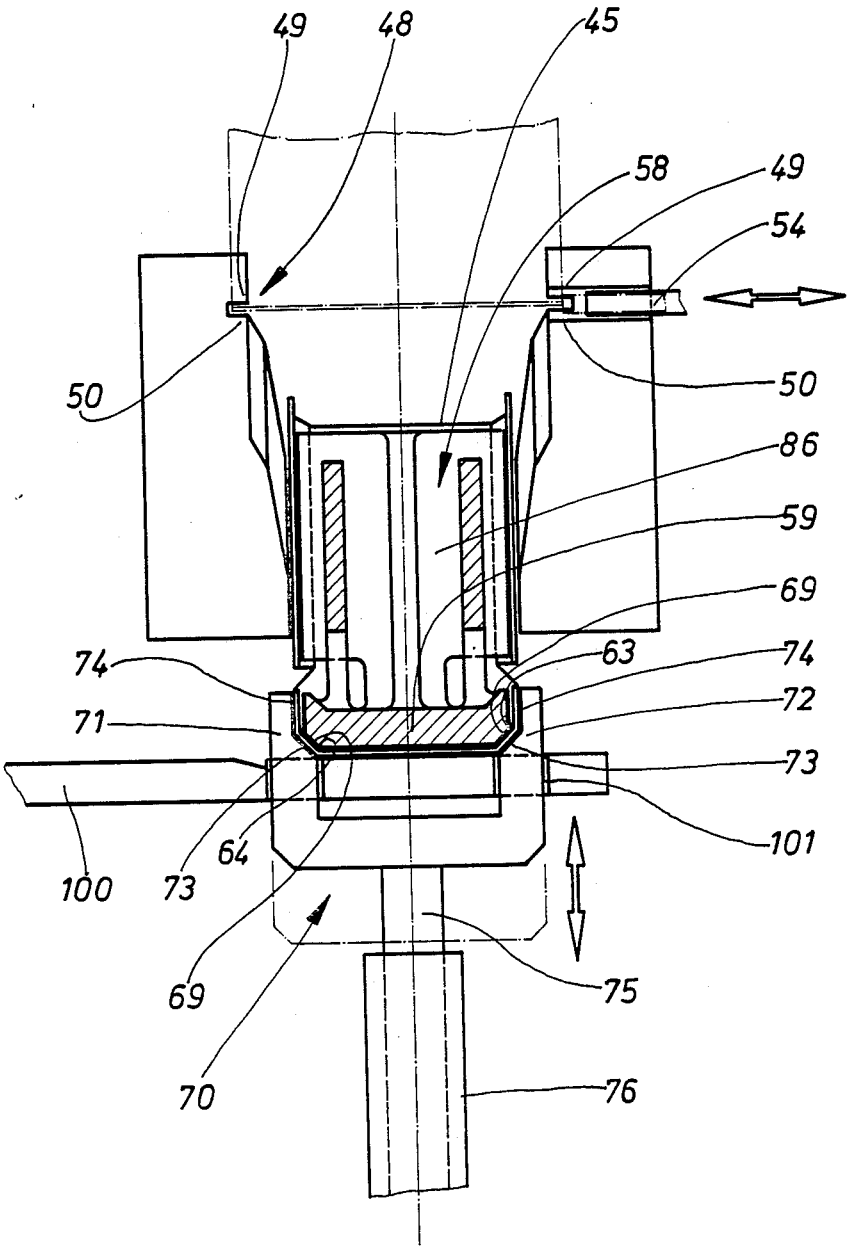
FIG. 9 shows a further cross-section in the sectional plane IX—IX of FIG. 4.

Folding the lid side tabs 34 arranged on the lid front wall 32 as well as shaping the lid longitudinal edges 40 which extend at this point—outside the folding turret 46 or the pocket 47—is carried out by separate folding tools which are fixed in the region of the folding station A. A side tab folder 70 can be supplied from below and effects, because of its design and together with a counter-tool, the folding of the lid side tabs 34 including the lid longitudinal edges 40. View in the radial direction the side tab folder 70 is designed fork-shaped (FIG. 9). Lateral folding tappets 71 and 72 are designed with obliquely directed folding surfaces 73 and upright folding surfaces 74 for erecting the lid side tabs 34 and forming the individual edges 41, 42 in this region. The side tab folder 70 is attached to a central ram 75 which can be moved up and down in a guide 76.

The counter folding member, which acts on the inside relative to the blank 20, used in the region of the lid front wall 32 is the appropriately dimensioned and designed punch plate 59. The latter is of reduced cross-section in the region of the lid top wall 31 but rests on top of the latter. In the region of the lid front wall 32 the punch plate 59 projecting from the pocket 47 is provided with a head piece 77 which has the cross-section shown in FIG.. 9, that is to say has vertical side surfaces and outer corners 63 and 64 which correspond to the corners formed by the folding surfaces 73 and 74 of the side tab folder 70 so that, in cooperation with the side tab folder 70, the lid longitudinal edges can be formed.

the blank 20 is fixed in the pocket 47 by means of lateral blank holders 78 which are pivotably attached, as two-armed levers, next to each pocket 47 in a bearing 79 on the folding turret 46. The free end of the blank holder 78 is mounted, by appropriate design, below the folding turret 46 or the pocket bottom 62 and provided with a guide roller 80 which, to control the movements, runs of a cam disk 81 located below the folding turret 46 in the region of the folding station A. Tension springs 82 which pivot the blank holders 78 into the holding position take effect outside the region of the cam disk 81.

In this holding position a holding lug 83 located on the radially outer end of the blank holder 78 comes to rest against the bevelled edge 69 of the side tabs 25 and in this way fixes the blank against radial movements. A top holder 84 likewise arranged on the blank holder 78 bears against a top edge of the side tabs 25 and thus presents upward movements. Finally there is provided a transverse ram 85 which likewise comes to rest against the side tabs 25 and holds the latter in the prescribed position.

A cam disk analogous to the cam disk 81 is also arranged in the region of an ejection station of the folding turret for opening the pockets.

Figure 4:
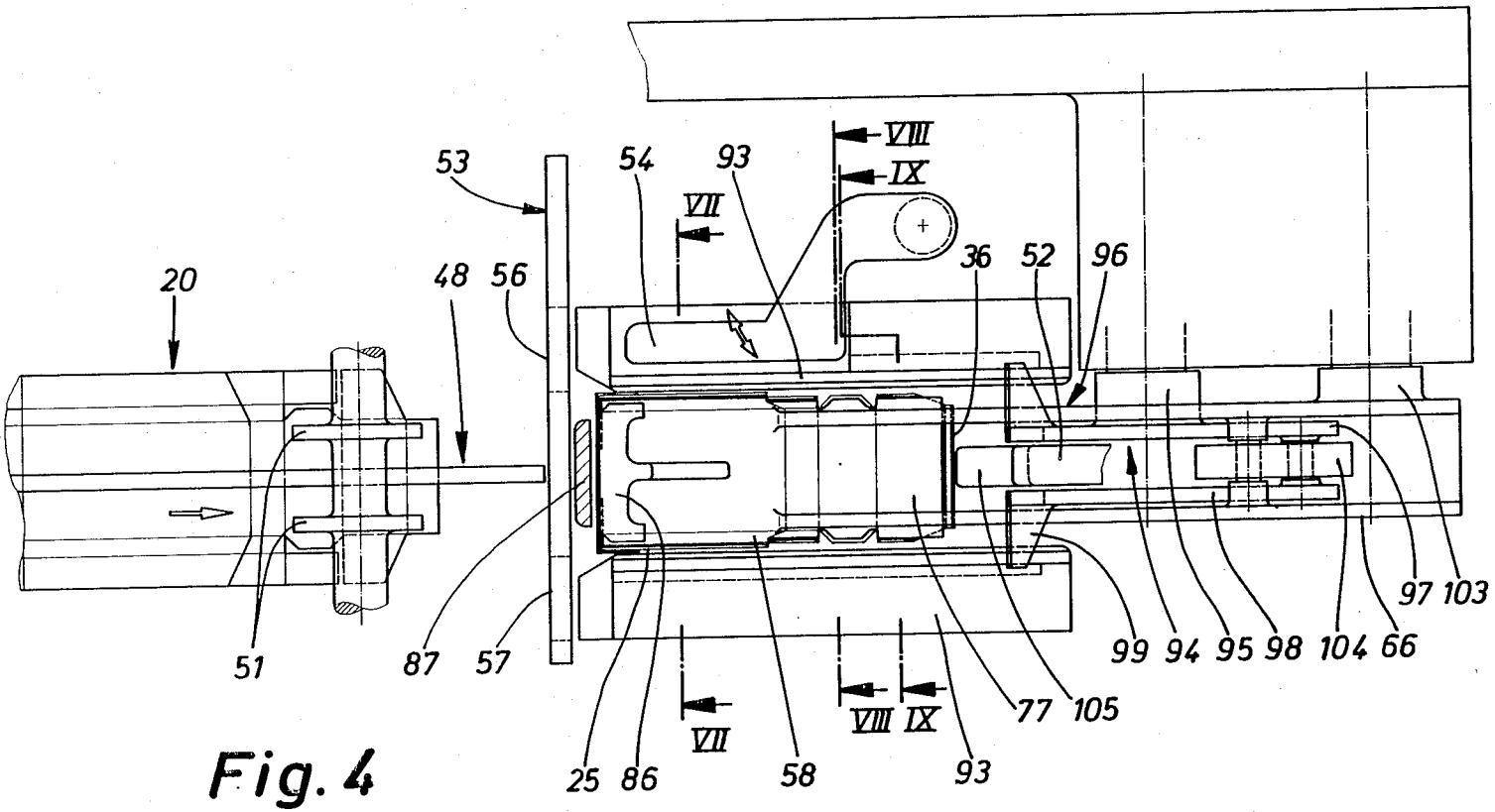
FIG. 4 shows a detail of the folding turret with folding tools in the region of the first folding station, likewise in plan.

The punch plate 59 of the shaping punch 58 is of angular design when viewed in the radial direction. An upright pressing leg 86 arranged on the inner edge is used for erecting the upright blank leg 45 in cooperation with an upright counter-wall on the inside of the pocket 47. The latter has markedly lower height than the upright blank leg 45 and extends only over a part region of the width of the front wall 21 (FIG. 4). On the other hand the pressing leg 86 extends essentially over the entire height of the front wall 21.

Figure 10:
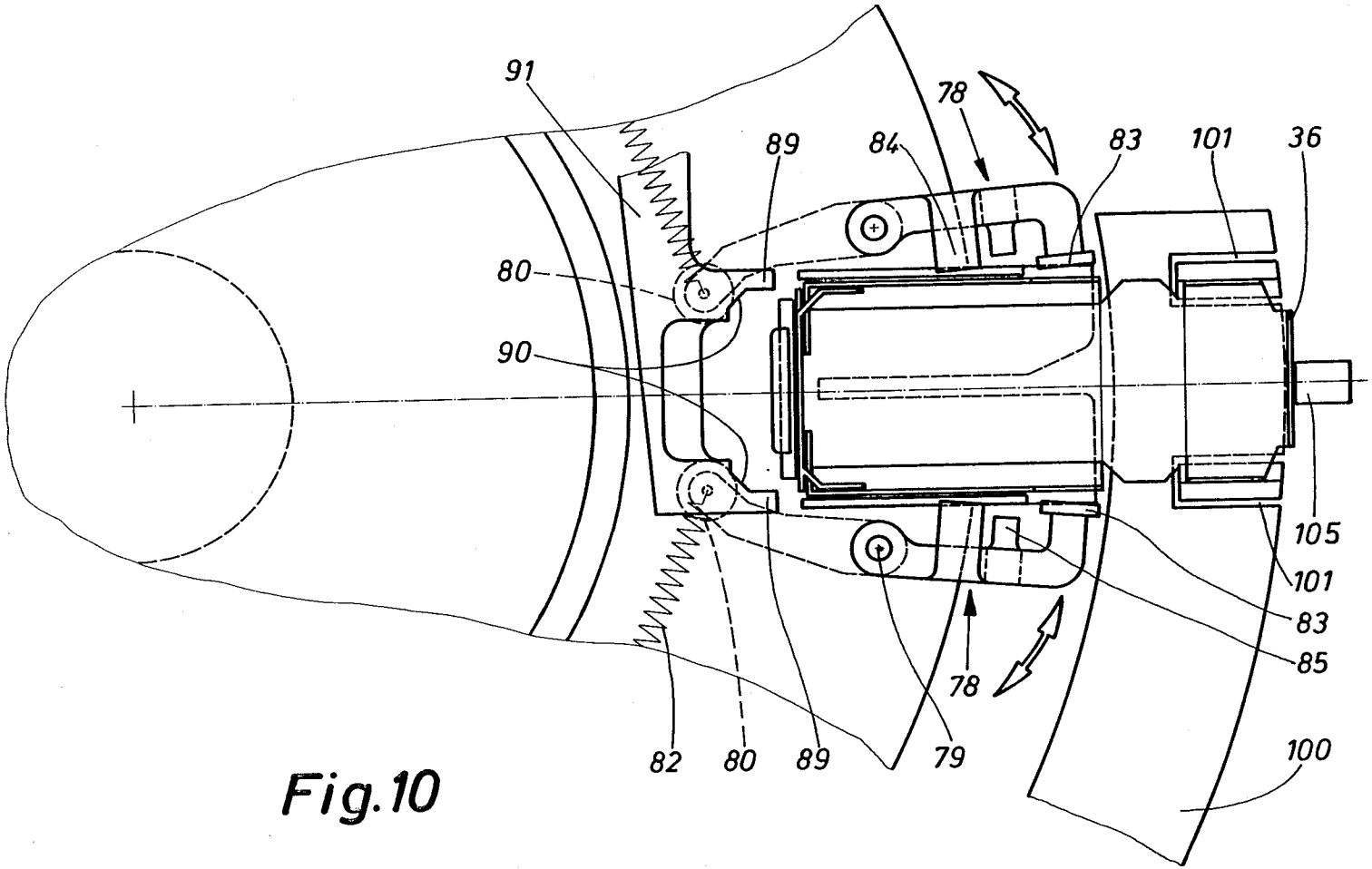
FIG. 10 shows a cut-out of the folding turret or a pocket of the turret with further folding members, in plan.

The side tabs 24 arranged on the front wall 21 are folded by a separate folding member, in particular a side tab former 88. The latter can be moved from a retracted position (FIG. 6, FIG. 10) with folding legs 89 arranged in the shape of a fork up to the upright blank leg 45 until it comes to rest against the counter wall 87 (in the central region). The folding legs 89 which have a profile analogous to the side tab folder 70, that is to say have oblique folding surfaces 90, result in the side tabs 24 being folded into a position transverse relative to the front wall 21, thereby specifically simultaneously forming of the bevelled longitudinal edges 37. By means of a transverse actuating arm 91 the side tab former 88 is moved in the radial direction. The counter-tool used is the pressing leg 86 which extends on the opposite side of the front wall 21 and is provided with a corresponding profile for forming the bevelled longitudinal edges 37.

When inserting the blank 20 into the pocket 47 in the region of the folding station A blank regions are preshaped or prefolded. The bottom guide 50 of the blank-conveying track 48 is directed, by a downward-directed oblique guide leg 92, towards the pocket 47 and terminates directly above the counter-wall 87 of the latter. Moreover, conveying guide walls 93 are arranged on both sides of the pocket 47. These guide walls effect erecting of the side tabs of the blank during the downward movement executed by the shaping punch 58. The guide walls 93 form a constructional unit with the blank-conveying track 48.

Figure 5:
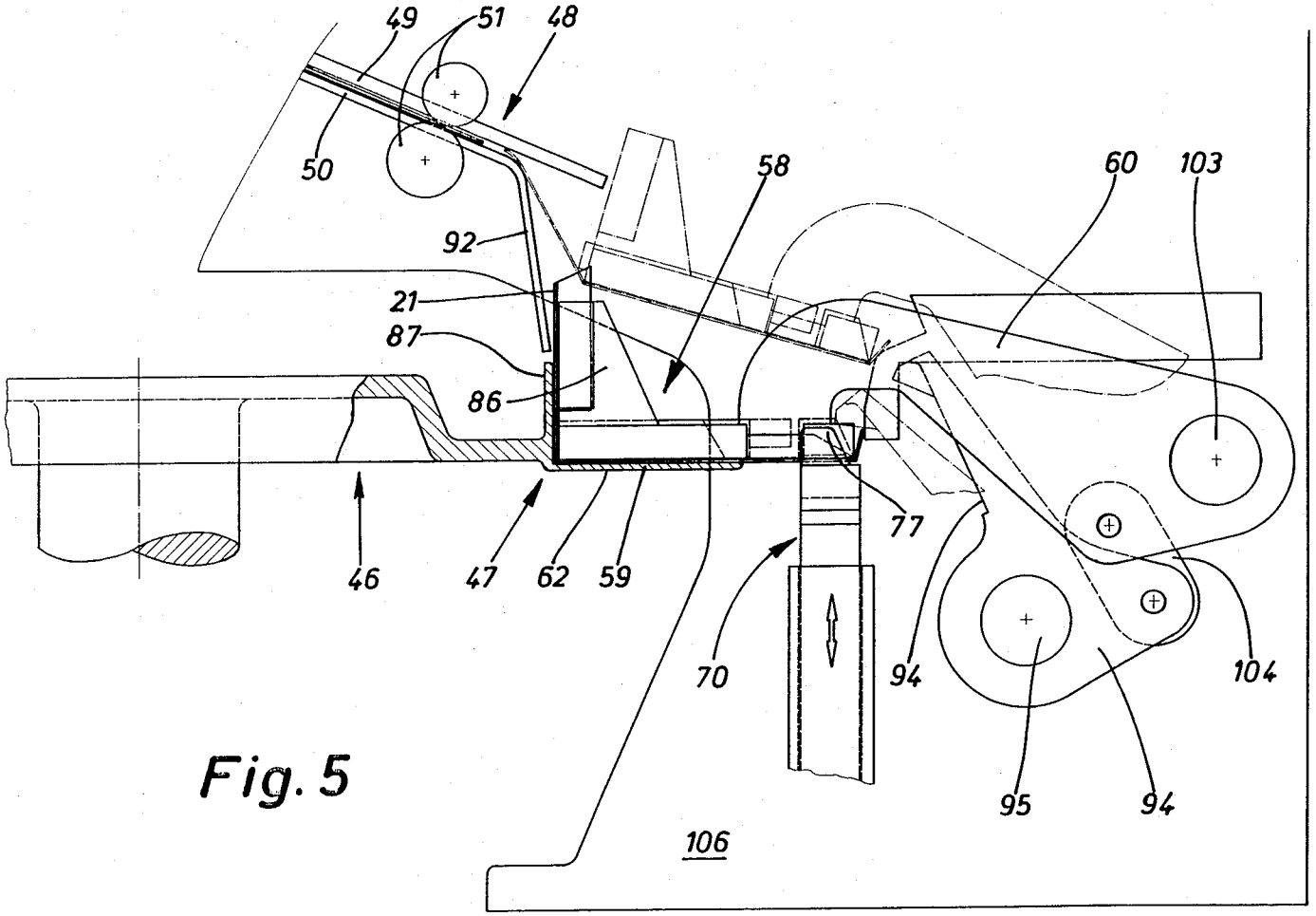
FIG. 5 shows a radial section through the folding turret in the region of the first folding station.

The inner tab 36 located on the outer end of the blank 20 is likewise preshaped during the downward movement. The stop piece 52 at the end of the blank-conveying track 48 is provided at the bottom with an arc-shaped guide extension 105. The latter is shaped such that the inner tab sliding along this guide extension 105 is erected and fixed in this position in the pocket 47 also (FIG. 5).

Figure 3:
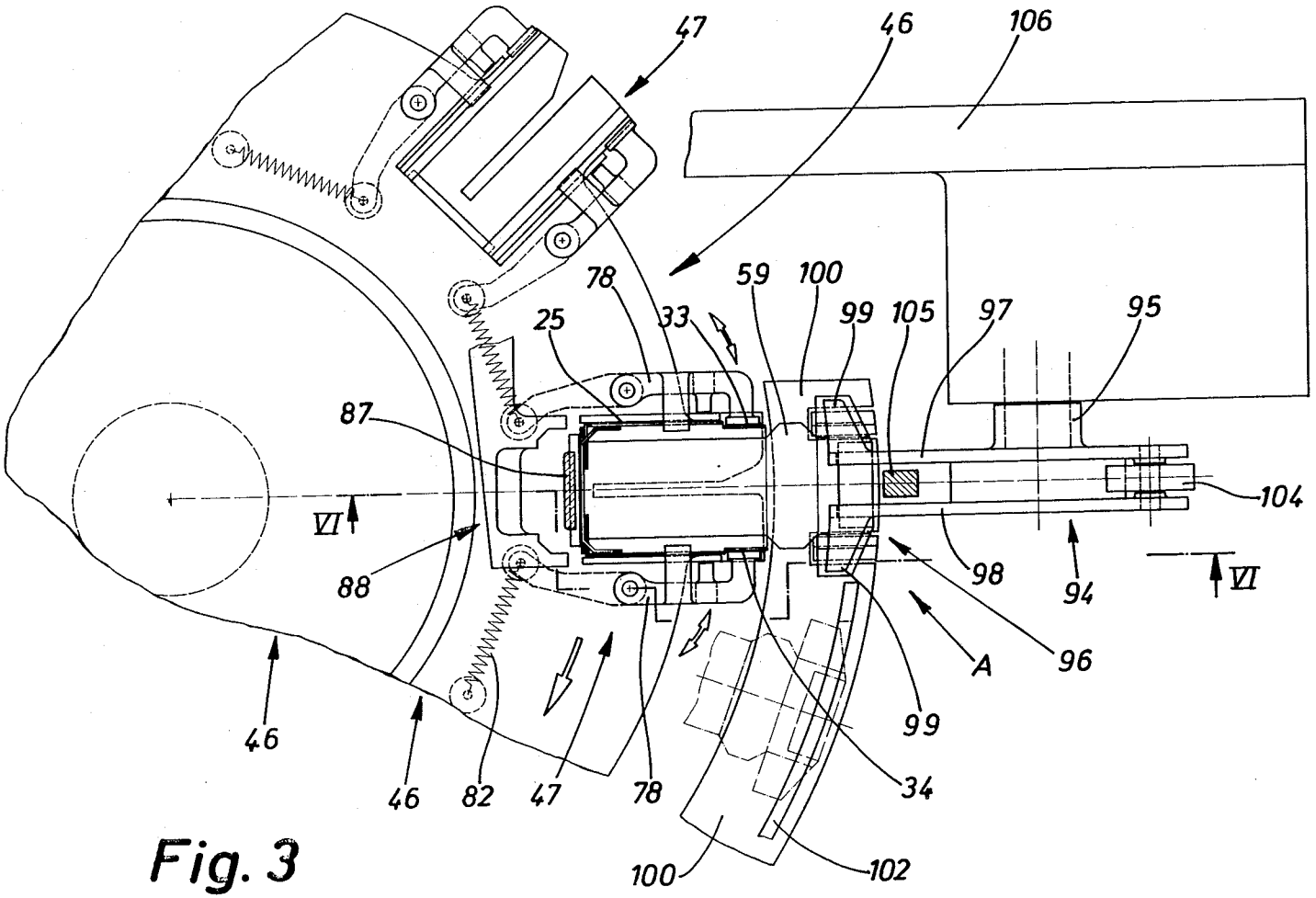
FIG. 3 shows a detail of the apparatus, in particular a folding turret in the region of a first folding station, in plan.

Folding the inner tab 36 against the top side of the lid front wall 32 is likewise carried out in the region of the folding station A. A folding and pressing lever is movable as a two-armed lever about a fixed pivot bearing 95 so that, by pivoting the folding and pressing lever 94 from the top position show in FIG. 1 into the position shown with dash-and-dot lines or into the position according to FIG. 6 the inner tab 36 is folded from the erected position until it comes to rest against the lid front wall 32 and is pressed against the latter. For this purpose, the end of the folding and pressing lever 94 is provided with a pressing head 96 which grips and presses the inner tab 36. As can be seen from FIG. 3 the folding and pressing lever 94 consists of two struts 97 and 98 which are arranged at a distance from each other and on each end of which a pressing head 96 is formed. Furthermore, laterally projecting pressure wings 99 are arranged on the ends of the folding and pressing lever 94 and the struts 97, 98. These pressure wings have the task, during the closing movement of the folding and pressing lever 94, that is to say while pressure is exerted on the inner tab 36, of folding the previously erected lid side tab 34 in the region of the lid front wall 32 downwards again, approximately back into the initial position.

In the region of the above-described folding members, that is to say outside the region of the pocket 47, a fixed pressure member 100 forms the bottom counter-bearing for the folding members. The blank regions projecting from the pocket 47 rest on the pressure member 100. This member extends over a relatively long region along the periphery of the folding turret 46, concentrically with the latter. In the region of the folding station A the pressure member 100 is provided with passage recesses 101 which permit passage of the folding tappets 71, 72 of the side tab folder 70 from below.

Outside the region of the folding station A there is arranged at a small distance above the pressure member 100 a guide segment 102. This guide segment holds the folded back lid side tabs 34 in the flat position during the advance of the blank by rotation of the folding turret.

The folding and pressing lever 94 on the one hand and the pressure lever 60 on the other are coupled to one another via a gear. A steering lever 104 is interposed as a coupling member between the pressure lever 60, which is pivotable about the pivot bearing 103, and the folding and pressing lever 94. The connection is such that, during an upward movement of the pressure lever 60 into the upper initial position shown, for example, in FIG. 6, the folding and pressing lever 94 is at the same time pivoted into the folding and pressing position. Correspondingly, the movement goes in the opposite direction during lowering of the pressure lever 60. The pivot bearing 95 for the folding and pressing lever 94 and the pivot bearing 103 of the pressure lever 60 are arranged on a common support, in particular on a supporting wall 106 of the machine.

We claim:

1. A process for producing elongated, essentially cuboid packs of the hinge-lid type from a horizontal blank having regions at least for a front wall (21), front wall side tabs (24) for side walls, a rear wall (23), rear wall side tabs (25) for side walls, a bottom wall (22), a lid rear wall (30) with lid side tabs (33) for forming lid side walls, and a lid front wall (32) with lid side tabs (34) for forming lid side walls, wherein each of said walls is connected to its side tabs with narrow longitudinal side strips to form a pack with an octagonal transverse cross-section and with beveled longitudinal edges, said process comprising the steps of:

(a) simultaneously folding into an upright position, relative to the horizontal rear wall (23), the front wall (21) together with the bottom wall (22) and the rear wall side tabs (25) arranged on the rear wall (23), while folding the rear wall side strips away from the plane of the rear wall (23) to an angle less than 90° to form the rear wall beveled longitudinal edges (38);

(b) then, simultaneously folding into a position, which is transverse to the front wall (23), side tabs (24) arranged on the front wall (21), and folding the lid rear wall and front wall side tabs into an upright position, while folding the front wall side strips away form the plane of the front wall (21) to form the beveled front wall longitudinal edges (37) and folding the lid rear wall and front wall side tabs away form the plane of the lid rear wall and front wall to form the lid rear wall and front wall beveled longitudinal edges (39, 40), all prior to filling and final folding of the pack.

2. The process as claimed in claim 1, wherein the blank has a region for bottom corner tabs (26), connected with the side tabs (25) of the rear wall (23), and wherein step (a) further comprises folding said bottom corner tabs (26) into an angled intermediate folding position.

3. The process as claimed in claim 1, wherein the blank has a region for a lid inner tab (36), and wherein said process comprises the further step: (c) simultaneously folding back the lid front wall side tabs (34) into an essentially horizontal initial position, and folding the inner tab (36) against the inside of the lid front wall (32), all prior to filling and final folding of the pack.

* * * * *